US006983122B2

(12) United States Patent
Hayamizu et al.

(10) Patent No.: US 6,983,122 B2
(45) Date of Patent: Jan. 3, 2006

(54) IMAGE FORMING APPARATUS

(75) Inventors: Tadashi Hayamizu, Fukuoka (JP); Kazuhiro Kumadaki, Fukuoka (JP); Masayoshi Kondou, Fukuoka (JP); Shinichi Tanaka, Fukuoka (JP)

(73) Assignee: Matsushita Electric Industrial Co., Ltd., Oaska (JP)

( * ) Notice: Subject to any disclaimer, the term of this patent is extended or adjusted under 35 U.S.C. 154(b) by 0 days.

(21) Appl. No.: 10/654,880

(22) Filed: Sep. 5, 2003

(65) Prior Publication Data

US 2004/0052563 A1 Mar. 18, 2004

(30) Foreign Application Priority Data

Sep. 12, 2002 (JP) ..... 2002-266720

(51) Int. Cl.
*G05G 15/00* (2006.01)

(52) U.S. Cl. ..... 399/405; 399/364; 399/401; 271/184; 271/185

(58) Field of Classification Search ..... 399/401, 399/361, 364, 403, 405; 271/184, 185
See application file for complete search history.

(56) References Cited

U.S. PATENT DOCUMENTS

| | | | | | |
|---|---|---|---|---|---|
| 4,262,895 | A | * | 4/1981 | Wenthe, Jr. | 271/65 |
| 4,586,812 | A | * | 5/1986 | Kaneko et al. | 355/24 |
| 5,014,976 | A | | 5/1991 | Muck et al. | |
| 5,166,738 | A | * | 11/1992 | Tani | 399/402 |
| 5,296,904 | A | * | 3/1994 | Jackson | 399/328 |
| 6,089,703 | A | * | 7/2000 | Pearson | 347/102 |
| 6,130,762 | A | | 10/2000 | Hwang et al. | |
| 6,323,939 | B1 | | 11/2001 | Suzuki | |
| 6,618,577 | B2 | * | 9/2003 | Omura | 399/401 |
| 6,674,035 | B2 | * | 1/2004 | Ito | 209/563 |
| 6,782,236 | B2 | * | 8/2004 | Sasaki et al. | 399/401 |

FOREIGN PATENT DOCUMENTS

| | | |
|---|---|---|
| EP | 0414552 | 2/1991 |
| JP | 58-118666 | 7/1983 |
| JP | 9-012196 | 1/1997 |
| JP | 11193159 | 7/1999 |
| JP | 11-255393 | 9/1999 |
| JP | 2001-294369 | 10/2001 |

OTHER PUBLICATIONS

English Language Abstract of JP 58–118666.
English Language Abstract of JP 2001–294369.
English Language Abstract of JP 11–193159.

* cited by examiner

*Primary Examiner*—Andrew H. Hirshfeld
*Assistant Examiner*—Dave A. Ghatt
(74) *Attorney, Agent, or Firm*—Greenblum & Bernstein, P.L.C.

(57) ABSTRACT

In an image forming apparatus having a double side printing function, paper on which printing has been completed is prevented from being caught between paper ejection rollers. The apparatus has a first paper ejection roller which is provided at a terminal end section of a paper transport path, a second paper ejection roller which is provided such that it is urged into contact with the first paper ejection roller to switch back printed paper in a double side printing mode in cooperation with the first paper ejection roller, a third paper ejection roller which is provided in a position opposite to the second paper ejection roller such that it is urged into contact with the first paper ejection roller to eject paper on which printing has been completed in the double side printing mode onto an ejected paper tray in cooperation with the first paper ejection roller, and a stopper for preventing the paper ejected onto the ejected paper tray from being caught between the first and second paper ejection rollers and between the first and third paper ejection rollers.

19 Claims, 7 Drawing Sheets

IMAGE FORMING APPARATUS

BACKGROUND OF THE INVENTION

The present invention relates to image forming apparatus such as copiers, facsimile machines, and printers.

Some image forming apparatus such as printers, copiers, and facsimile machines have the function of printing both sides of a printing medium such as paper.

FIGS. 10 and 11 are illustrations showing a structure of the neighborhood of paper ejection rollers of an image forming apparatus according to the related art having the double side printing function.

In the image forming apparatus having the double side printing function, a first paper ejection roller 150, a second paper ejection roller 160, and a third paper ejection roller 170 are provided at a terminal end section of a paper transport path. The first paper ejection roller 150 located in the middle can be rotated in two directions, i.e., forward and reverse directions. Each of the second paper ejection roller 160 and the third paper ejection roller 170 provided in positions opposite to each other on both sides of the paper ejection roller 150 is urged into contact with the first paper ejection roller 150 and is rotated in the forward direction relative to the first paper ejection roller 150.

In such a configuration, during double side printing, paper 90 which has been printed on one side thereof is switched back by the first and second paper ejection rollers 150 and 160 and is fed according to the next printing command to be subjected to the printing process again, whereby printing is performed on the other side.

Paper 90 on which printing has been completed on either single side printing basis or double side printing basis is sandwiched and transported by the first and third paper ejection rollers 150 and 170 to be ejected on to an ejected paper tray 130.

Since the first, second, and third paper ejection rollers 150, 160, and 170 rotate in two directions, i.e., forward and reverse directions, either of the pair of the first paper ejection roller 150 and the second paper ejection roller 160 and the pair of the first paper ejection roller 150 and the paper ejection roller 170 rotates in the direction opposite to the direction of ejecting the paper 90, i.e., the direction of feeding the paper into the apparatus, depending on their rotating directions.

As thus described, in the image forming apparatus having the double side printing function, since either of the pairs of paper ejection rollers rotates in the direction of feeding the paper into the apparatus from the gap between them, when someone attempts to collect paper stored in the ejected paper tray after printing, the paper can be caught between such paper ejection rollers.

SUMMARY OF THE INVENTION

It is therefore an object of the invention to provide an image forming apparatus having the double side printing function in which there is no possibility that a recording medium on which printing has been completed is caught between paper ejection rollers.

In order to solve the problem, an image forming apparatus according to the invention has: a first paper ejection roller which is provided at a terminal end section of a recording media transport path and which can rotate in two directions, i.e., forward and reverse directions; a second paper ejection roller which is provided such that it is urged into contact with the first paper ejection roller and which rotates in the forward direction relative to the first paper ejection roller to switch back a recording medium which has been printed on one side thereof in a double side printing mode in cooperation with the first paper ejection roller; a third paper ejection roller which is provided in a position opposite to the second paper ejection roller, with the first paper ejection roller interposed between them, such that it is urged into contact with the first paper ejection roller and which rotates in the forward direction relative to the first paper ejection roller to eject a recording medium on which printing has been completed in the double side printing mode onto an ejected paper tray in cooperation with the first paper ejection roller; and a stopper for preventing a recording medium which has been ejected onto the ejected paper tray from being caught between the first paper ejection roller and the second paper ejection roller and between the first paper ejection roller and the third paper ejection roller.

Since a recording medium which has been ejected is thus prevented by the stopper from coming near the gaps between the paper ejection rollers, there is no possibility that the recording medium on which printing has been completed will be caught between the paper ejection rollers.

DETAILED DESCRIPTION OF THE PREFERRED EMBODIMENTS

Figure 1:
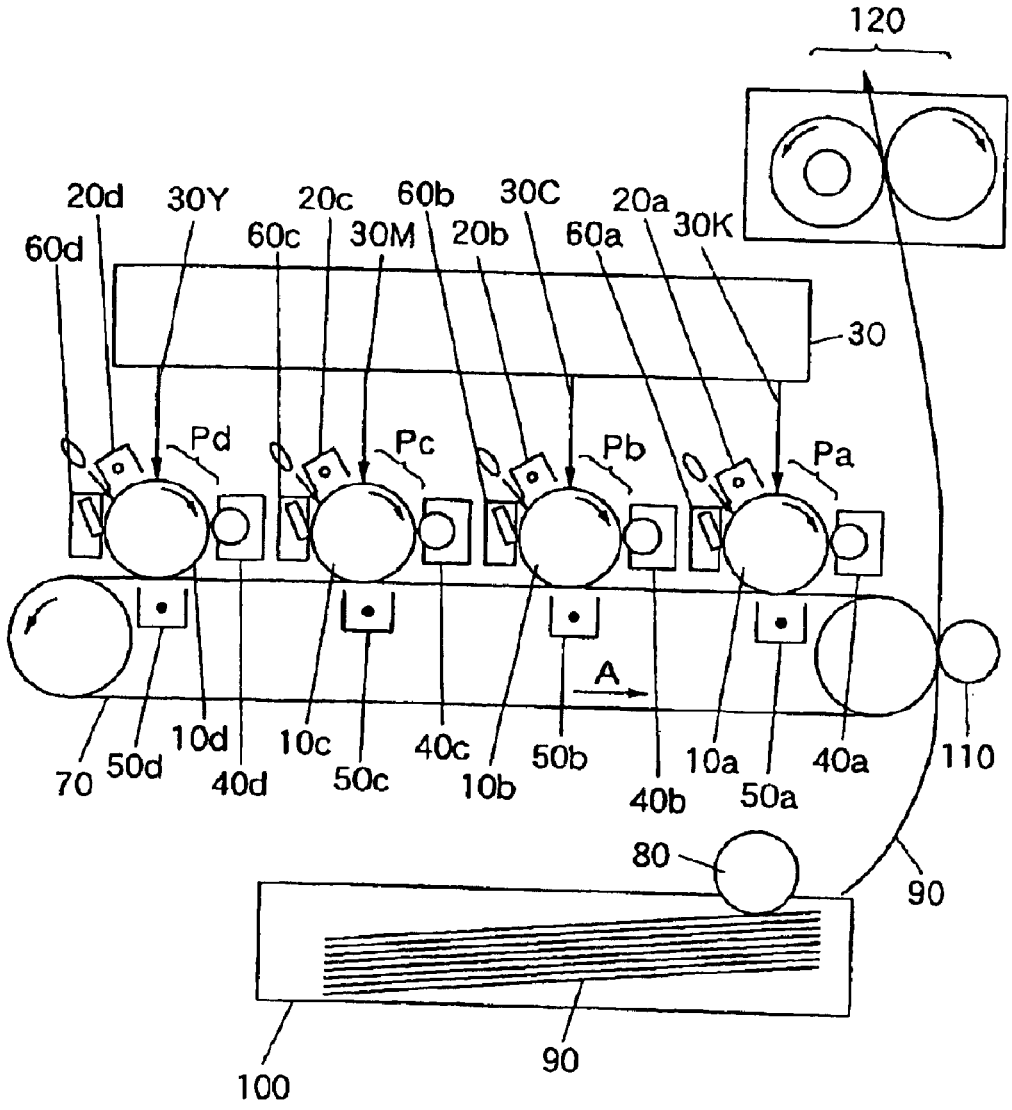
FIG. 1 is an illustration showing a configuration of an image forming apparatus that is an embodiment of the invention.

In an aspect of the invention, there is provided an image forming apparatus having: a first paper ejection roller which is provided at a terminal end section of a recording media transport path and which can rotate in two directions, i.e., forward and reverse directions; a second paper ejection roller which is provided such that it is urged in contact with the first paper ejection roller and which rotates in the forward direction relative to the first paper ejection roller to switch back a recording medium which has been printed on one side thereof in a double side printing mode in cooperation with the first paper ejection roller; a third paper ejection roller which is provided in a position opposite to the second paper ejection roller, with the first paper ejection roller interposed between them, such that it is urged into contact with the first paper ejection roller and which rotates in the forward direction relative to the first paper ejection roller to eject a recording medium on which printing has been completed in the double side printing mode onto an ejected paper tray in cooperation with the first paper ejection roller; and a stopper for preventing a recording medium which has been ejected onto the ejected paper tray from being caught between the first paper ejection roller and the second paper ejection roller and between the first paper ejection roller and the third paper ejection roller. Since a recording medium which has been ejected is thus prevented by the stopper from coming near the gaps between the paper ejection rollers, there is no possibility that the recording medium on which printing has been completed will be caught between the paper ejection rollers.

In another aspect of the invention, there is provided an image forming apparatus as described above, wherein the stopper is mounted on a shaft of the first paper ejection roller and wherein a section of the stopper in a direction orthogonal to the axial direction of the shaft has a V-like shape that diverges in the direction in which a recording medium is ejected. Since a recording medium which has been ejected is thus prevented by the stopper from coming near the gaps between the paper ejection rollers, there is no possibility that the recording medium on which printing has been completed will be caught between the paper ejection rollers.

Preferred embodiments of the invention will now be described with reference to FIGS. 1 to 9. Like members are indicated like reference numerals in those figures and will not be described repeatedly.

(First Embodiment)

First, an image forming apparatus according to a first embodiment of the invention will be schematically described. The image forming apparatus described in the present embodiment is an apparatus employing electrophotography and, in particular, it is a tandem type apparatus which has a developer for each of toners in four basic colors that contribute to color development of a color image and in which images in the four colors are overlapped with each other on a transfer body and are transferred to a sheet material at a time. However, the invention is not limited tandem type image forming apparatus and may obviously applied to any type of image forming apparatus regardless of the number of developers and the presence of an intermediate transfer body.

Referring to FIG. 1, provided around photosensitive drums 10*a*, 10*b*, 10*c*, and 10*d* are: charging units 20*a*, 20*b*, 20*c*, and 20*d* for uniformly charging surfaces of the photosensitive drums 10*a*, 10*b*, 10*c*, and 10*d*, respectively, at a predetermined potential; an exposure unit 30 for irradiating the charged photosensitive drums 10*a*, 10*b*, 10*c*, and 10*d* with scan lines 30K, 30C, 30C, and 30Y that are laser beams associated with image data in certain colors to form electrostatic latent images on them; developing units 40*a*, 40*b*, 40*c*, and 40*d* for developing the electrostatic latent images formed on the photosensitive drums 10*a*, 10*b*, 10*c*, and 10*d*; transfer units 50*a*, 50*b*, 50*c*, and 50*d* for transferring toner images developed on the photosensitive drums 10*a*, 10*b*, 10*c*, and 10*d* onto an endless intermediate transfer belt (intermediate transfer body) 70; and cleaning units 60*a*, 60*b*, 60*c*, and 60*d* for removing any residual toner present on the photosensitive drums 10*a*, 10*b*, 10*c*, and 10*d* after the toner images are transferred from the photosensitive drums 10*a*, 10*b*, 10*c*, and 10*b* to the intermediate transfer belt 70.

The exposure unit 30 is provided with a predetermined inclination relative to the photosensitive drums 10*a*, 10*b*, 10*c*, and 10*d*. The intermediate transfer belt 70 rotates in the direction of the arrow A in the illustrated case. A black image, a cyan image, a magenta image, and a yellow image are formed at image forming stations Pa, Pb, Pc, and Pd, respectively. Single color images in respective colors formed on the photosensitive drums 10*a*, 10*b*, 10*c*, and 10*d* are sequentially transferred onto the intermediate transfer body in an overlapping relationship to form a full color image on the same.

A paper supply cassette 100 containing sheets of paper (recording media) 90 is detachably provided in a lower part of the apparatus. The sheets of paper 90 are fed by a paper feed roller 80 one by one from the paper supply cassette 100 into a paper transport path (recording media transport path).

On the paper transport path, there is provided a paper transfer roller 110 which is put in contact with an outer circumferential surface of the intermediate transfer belt 70 over a predetermined distance to transfer a color image formed on the intermediate transfer belt 70 onto a sheet of paper 90 and an IH (induction heating) fixing device 120 for fixing the color image transferred to the sheet of paper 90 on the sheet of paper 90 using a pressure resulting from the sandwiching with and the rotation of the roller and using heat.

In the image forming apparatus having such a configuration, a latent image of image information in black component color is formed on the photosensitive drum 10*a* by the charging unit 20*a* of the image forming station Pa and the exposure unit 30. The latent image is visualized by the developing unit 40*a* having black toner into a black toner image which is then transferred by the transfer unit 50*a* onto the intermediate transfer belt 70.

A latent image in cyan component color is formed at the image forming station Pb while the back toner image is transferred onto the intermediate transfer belt 70, and a cyan toner image is then developed by the developing unit 40*b*. The cyan toner image is then transferred by the transfer unit 50*b* of the image forming station Pb onto the intermediate transfer belt 70 on which the transfer of the black toner image at the preceding image forming station Pa has been completed, the cyan toner image being then overlapped with the black toner image.

Thereafter, a magenta toner image and a yellow toner image are formed according to the same method. When the toner images in four colors are overlapped with each other on the intermediate transfer belt to, the toner images in four colors are transferred by the paper transfer roller 110 at a time onto a sheet of paper 90 fed by the paper feed roller 80 from the paper supply cassette 100. The transferred toner images are heated and fixed on the paper 90 by the IH fixing device 120 to form a full color image on the paper 90.

A paper transport system in such an image forming apparatus will now be described.

Figure 2:
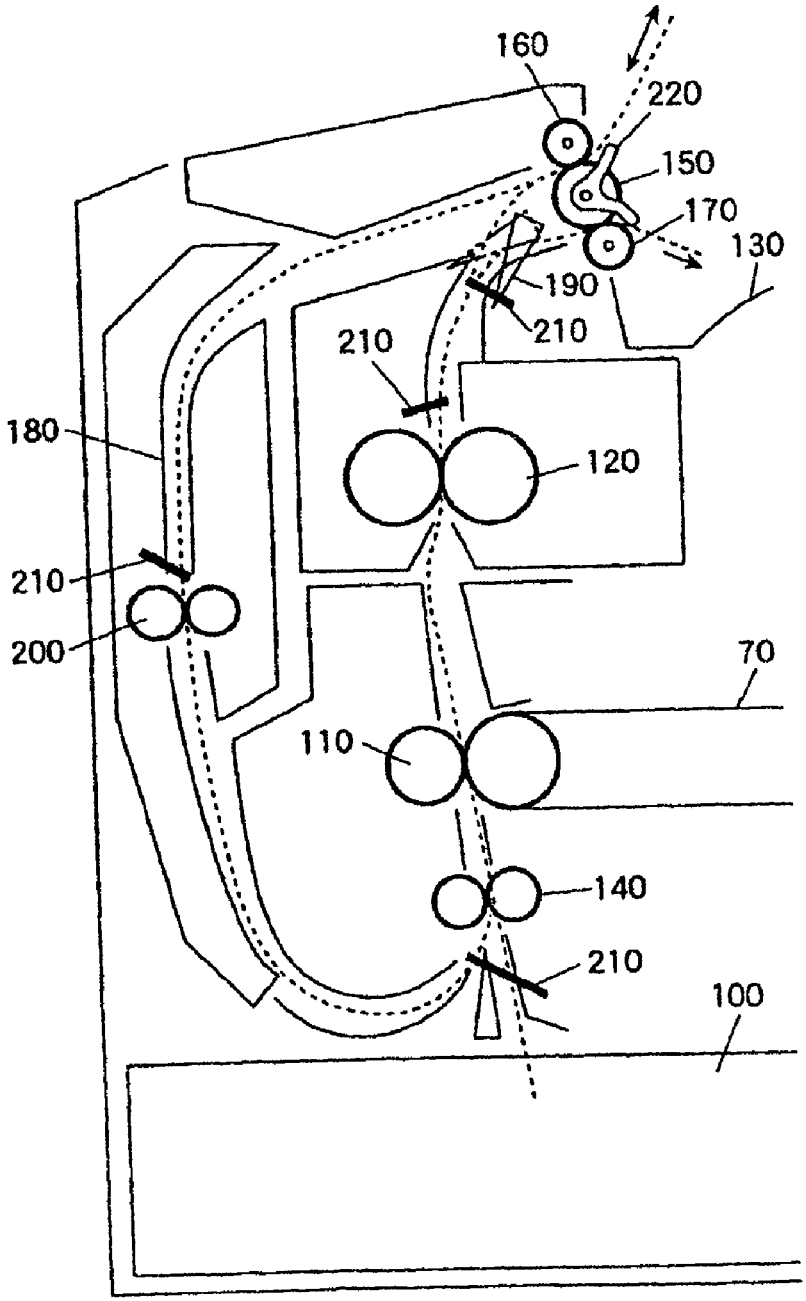
FIG. 2 is an illustration showing a paper transport system for double side printing in the image forming apparatus in FIG. 1.

As shown in FIG. 2, in a paper transport path from the paper supply cassette 100 to the ejected paper tray 130, there is provided a registration roller for timing a transfer onto a sheet of paper 90 under transportation, the paper transfer roller 110 for transferring toner images on the intermediate transfer belt 70 onto a sheet of paper 90, and the fixing device 120 for fixing the toner images on the paper 90. In the case of an image forming apparatus having the double side printing function, a first paper ejection roller 130, a second paper ejection roller 150, and a third paper ejection roller 170 are provided at a terminal section of the paper transport path.

The first paper ejection roller 150 located in the middle can be rotated in two directions, i.e., forward and reverse directions. Each of the second paper ejection roller 150 and the third paper ejection roller 170 provided on both sides of the first paper ejection roller 150 in positions opposite to each other is urged into contact with the first paper ejection roller 150 and is rotated in the forward direction relative to the first paper ejection roller 170.

A sheet of paper 90 which has been printed on one side thereof in the double side printing mode is switched back by the first and second paper ejection rollers 150 and 160, and a sheet of paper 90 on which printing (double side printing or single side printing) has been completed is ejected by the first paper ejection roller 150 and the third paper ejection roller 170 onto the ejected paper tray 130.

A stopper 220 is attached to a shaft of the first paper ejection roller 150, a section of the stopper in a direction orthogonal to the axial direction of the shaft of the first paper ejection roller 150 having a V-like shape that diverges in the direction in which a sheet of paper 90 is ejected.

The stopper 220 having such a shape prevents a sheet of paper 90 which has been ejected onto the ejected paper tray 130 from being caught between the first paper ejection roller 150 and the second paper ejection roller 160 or between the first paper ejection roller 150 and the third paper ejection roller 170. Any shape other than the shape in the present embodiment may be employed for the stopper as long as it prevents a sheet of paper 90 ejected on the ejected paper tray 130 from being caught between the paper ejection rollers 150, 160, and 170.

A paper-inverting transport path 180 is formed to extend from the neighborhood of the terminal section of the paper transport path to a position before the transfer section, the transport path 180 inverting printed surfaces of a sheet of paper 90 which has been switched back. A guide member 190 is provided at a branch point between the paper transport path and the paper-inverting transport path 180 in the vicinity of the paper ejection rollers 150, 160, and 170. The guide member 190 switches the traveling path of sheets of paper 90 between first and second positions. In the first position, a sheet of paper 90 which has been printed and transported through the paper transport path to be subjected to double side printing is guided to the gap between the first paper ejection roller 150 and the second paper ejection roller 160. In the second position, a sheet of paper 90 which has been switched back by the first paper ejection roller 150 and the second paper ejection roller 160 is guided to the paper-inverting transport path 180. Also in the second position, a sheet of paper 90 which has been transported through the paper transport path after being printed (the paper having been printed on both sides in the double printing mode or printed on one side in the single side printing mode) is guided to the gap between the first paper ejection roller 150 and the third paper ejection roller 170.

A registration roller 200 is provided on the paper-inverting path 180 to time a transfer onto a sheet of paper 90 that is transported after being inverted, and appropriate sensors 210 are provided on the paper transport path and the paper-inverting transport path 180.

Figure 3:
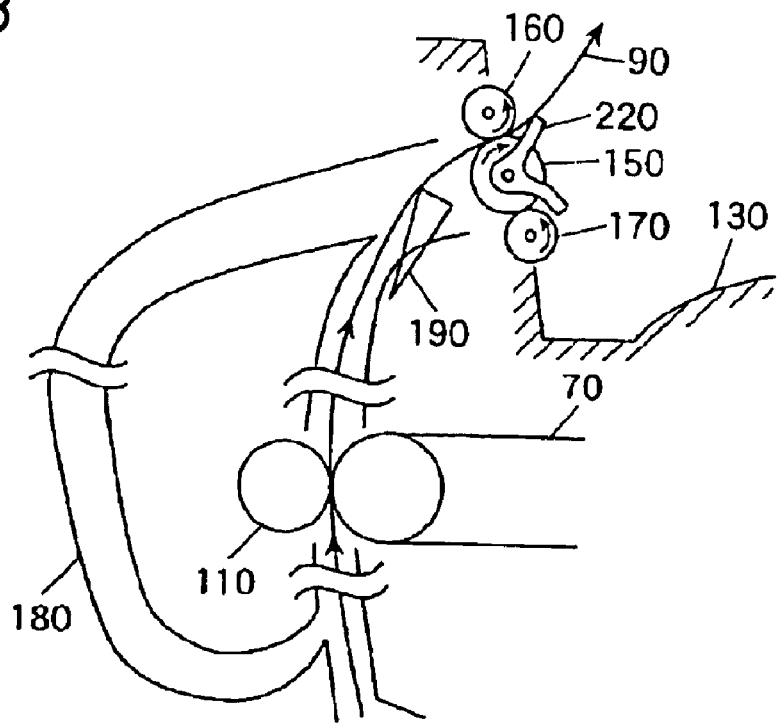
FIG. 3 is an illustration showing an operation of the apparatus and a paper transport path in the paper transport system shown in FIG. 2 associated with printing of a top side of paper in a double side printing mode.

In such a configuration, when one side of a sheet of paper 90 is printed in the double side printing mode, the guide member 190 assumes the first position as shown in FIG. 3 in which the first paper ejection roller 150 and the second paper ejection roller 160 rotate in the direction of sending the paper toward the ejected paper tray 130.

When printing is completed on one side of the paper 90, almost the entire area of the paper 90 is exposed toward the ejected paper tray 130, the paper 90 still sandwiched between the first paper ejection roller 150 and the second paper ejection roller 160.

Figure 4:
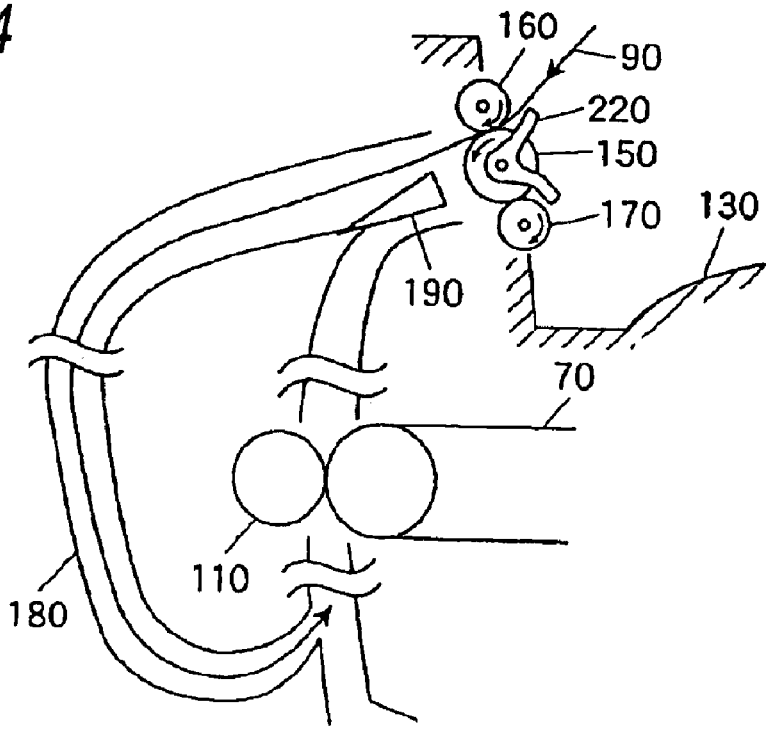
FIG. 4 is an illustration showing an operation of the apparatus and a paper transport path in the paper transport system in FIG. 2 associated with switching back of the paper after the top side printing in the double side printing mode.

Thereafter, as the guide member 190 is switched to the second position as shown in FIG. 4, the first paper ejection roller 150 and the second paper ejection roller 160 start rotating in the reverse direction. As a result, the paper 90 is switched back by the first paper ejection roller 150 and the second paper ejection roller 160 and is guided by the guide member 190 to the paper-inverting transport path 180.

Figure 5:
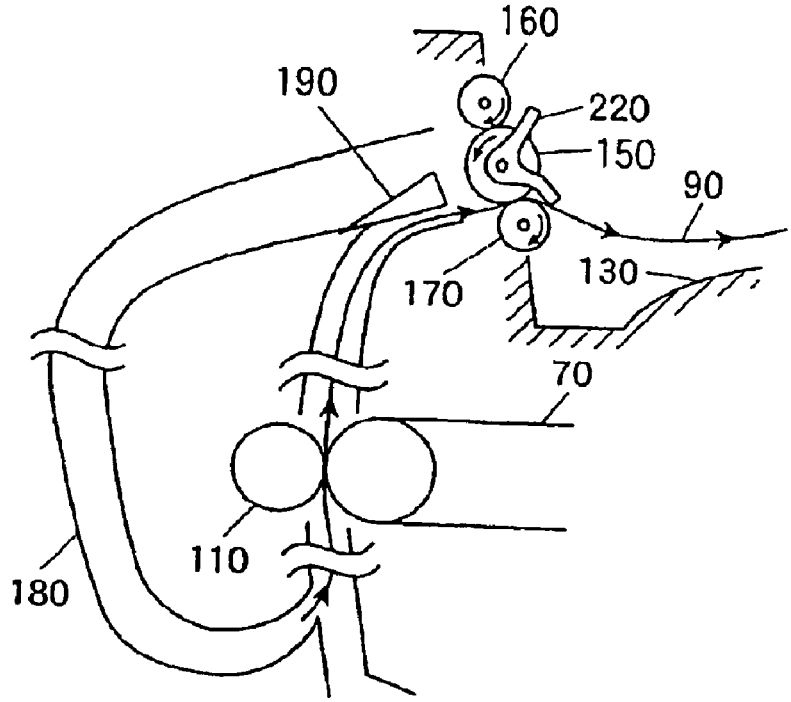
FIG. 5 is an illustration showing an operation of the apparatus an a paper transport path in the paper transport system in FIG. 2 associated with printing of the opposite side (bottom side) of the paper in the double side printing mode.

Then, the paper 90 passes through the paper-inverting transport. path 180 and is guided to the paper transport path again as shown in FIG. 5 to be printed on the opposite side. The paper is then sandwiched and transported by the first and third paper ejection rollers 150 and 170 to be ejected on to the ejected paper tray 130. In the single side printing mode, the guide member 190 assumes the second position in which the paper 90 is sandwiched and transported by the first and third paper ejection rollers 150 and 170 to be ejected onto the ejected paper tray 130.

Figure 6:
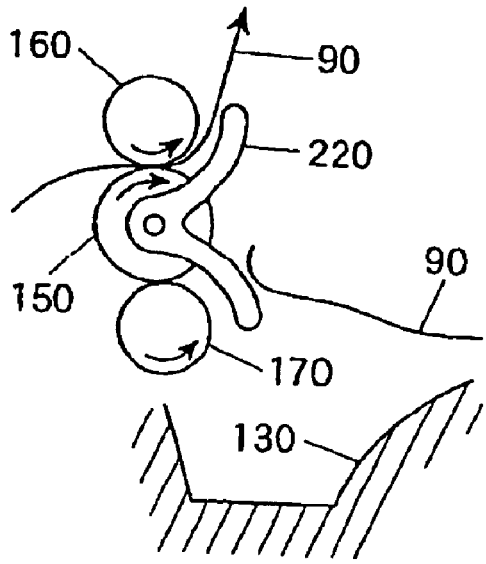
FIG. 6 is an illustration showing rotations of the first to third paper ejection rollers and an operation of the stopper in FIG. 3.

While the first paper ejection roller 150 and the second paper ejection roller 160 are rotating in the direction of ejecting a sheet of paper 90, the first paper ejection roller 150 and the third paper ejection roller 170 rotate in the direction of feeding the paper 90 into the apparatus through the gap between them. Even if someone attempts to collect sheets of papers 90 accumulated in the ejected paper tray 130 at this time, no sheet of paper 90 will be caught between the first paper ejection roller 150 and the third paper ejection roller 170 because any sheet of paper 90 coming near the gap between the first paper ejection roller 90 and the third paper ejection roller 170 will be blocked by the stopper 220, as shown in FIG. 6.

Figure 7:
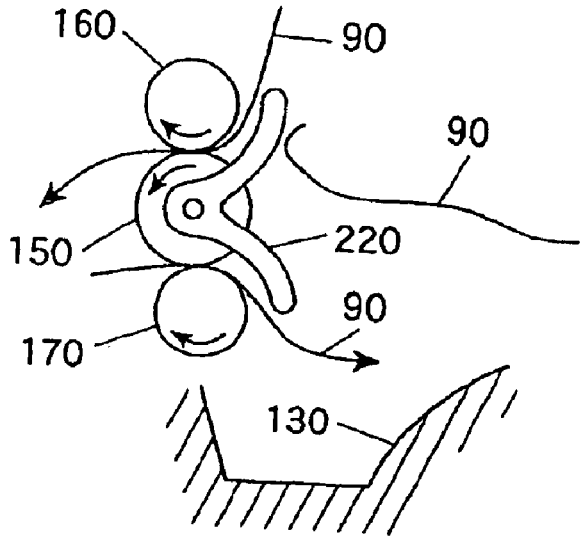
FIG. 7 is an illustration showing rotations of the first to third paper ejection rollers and an operation of the stopper in FIGS. 4 and 5.

While the first paper ejection roller 150 and the second paper ejection roller 160 are rotating in the direction of switching back a sheet of paper 90 or while the first paper ejection roller 150 and the third paper ejection roller 170 are rotating in the direction of ejecting the sheet of paper 90, the first paper ejection roller 150 and the second paper ejection roller 160 rotate in the direction of feeding the sheet of paper 90 into the apparatus through the gap between them. Even if someone attempts to collect sheets of papers 90 accumulated in the ejected paper tray 130 at this time, no sheet of paper 90 will be caught between the first paper ejection roller 150 and the second paper ejection roller 160 because any sheet of paper 90 coming near the gap between the first paper ejection roller 90 and the second paper ejection roller 160 will be blocked by the stopper 220 again, as shown in FIG. 7.

As thus described, in the image forming apparatus of the present embodiment, since a sheet of paper 90 which has been ejected is prevented by the stopper 220 from coming near the gap between the paper ejection rollers, there is no possibility that a sheet of paper 90 on which printing has been completed will be caught between the paper ejection rollers 150, 160, and 170.

(Second Embodiment)

Figure 8:
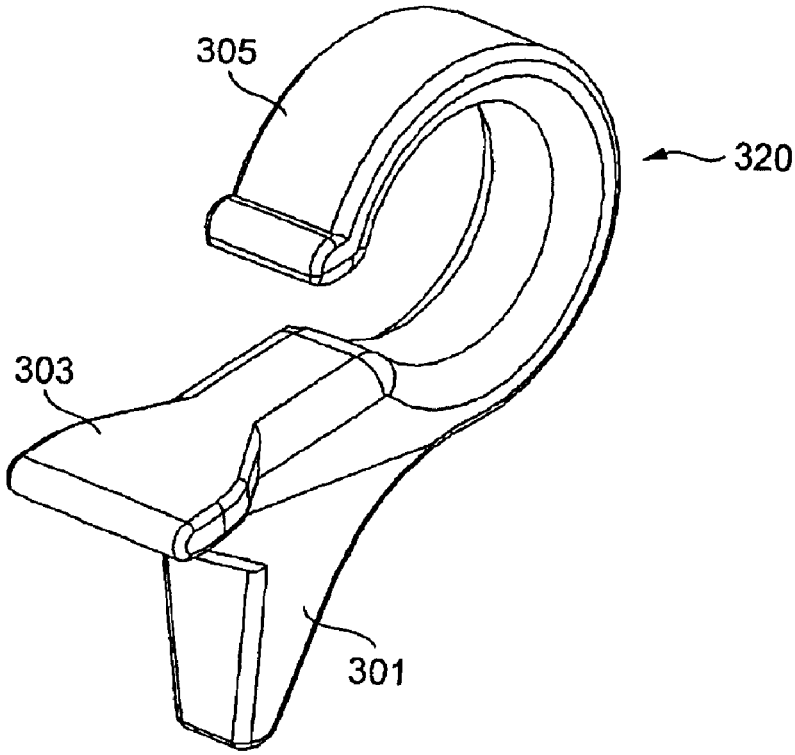
FIG. 8 is a perspective view of a stopper in a second embodiment of the invention.

A second embodiment of the invention will now be described with reference to FIGS. 8 and 9. The second embodiment is different from the first embodiment in the shape of a stopper 320 and, since the configurations of the embodiments are otherwise substantially identical, the description will omit elements other than the stopper.

A stopper 320 corresponding to the stopper 220 of the first embodiment has a catch preventing portion 301 and a rotation preventing portion 303, and it is integrally molded from a resin. A ring portion 305 has a cutout in a part thereof. The ring portion 305 is slidably fitted to the shaft of the first paper ejection roller 150 with a small gap left therebetween. Therefore, the stopper 320 is kept in the position shown in FIG. 9 by the weight of the stopper 320 itself when the first paper ejection roller 150 rotates in the forward or reverse direction. When a sheet of paper 90 which has been printed on both sides thereof is ejected from the gap between the paper ejection roller 150 and the paper ejection roller 170, the paper 90 is ejected onto the ejected paper tray 130 while pushing the stopper 320. At this time, the stopper 320 is rotated in the forward rotating direction of the paper ejection roller 150 as shown in FIG. 5 relative to the paper ejection roller 150.

Figure 9:
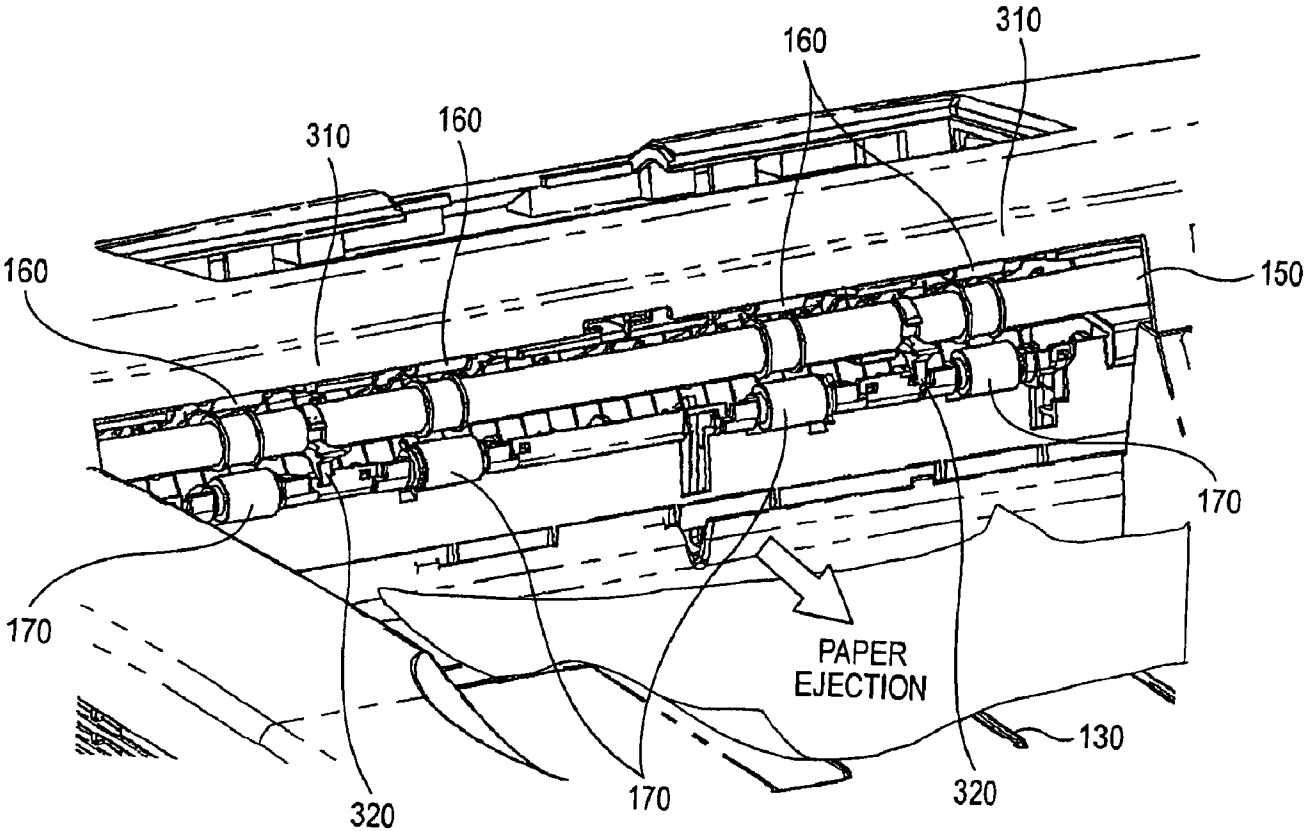
FIG. 9 is a partial perspective showing a mounted state of stoppers in the second embodiment of the invention.
Figure 10:
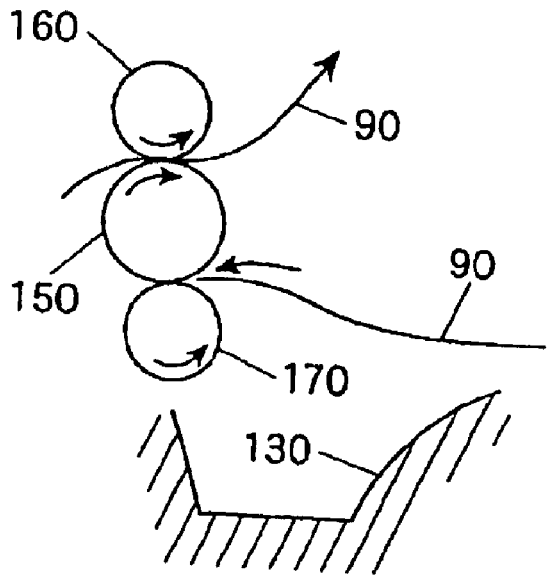
FIG. 10 is an illustration showing a structure of the neighborhood of paper ejection rollers in an image forming apparatus having a double side printing function according to the related art.
Figure 11:
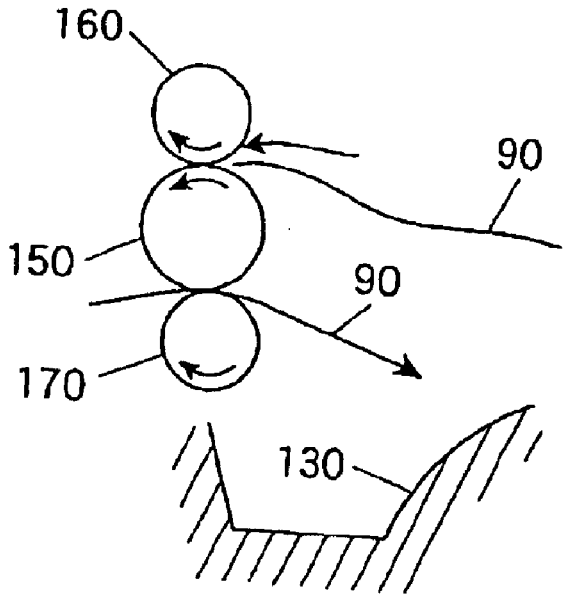
FIG. 11 is an illustration of the structure of the neighborhood of the paper ejection rollers in the image forming apparatus having a double side printing function according to the related art, in which the paper ejection rollers are shown in states of rotation different from those in FIG. 10.

Even when the stopper 320 is greatly rotated in the forward rotating direction of the paper ejection roller 150, since the rotation preventing portion 33 abuts on a part 310 of the housing of the image forming apparatus, the stopper 320 is unable to rotate any more and is returned to the position shown in FIG. 9 by the weight of the stepper 320 itself.

Further, two such stoppers 320 made of resin are provided on the shaft of the paper ejection roller 150 as shown in FIG. 9 to accommodate various sizes of paper.

In the second embodiment, even when a sheet of paper 90 which has been ejected onto the ejected paper tray 130 comes near the gap between the paper ejection rollers 150 and 160 or the gap between the paper ejection rollers 150 and 170 because of wind, since the paper 90 is blocked by the stoppers 320, it is possible to prevent the paper 90 from being caught between the paper ejection rollers 150 and 160 or between the paper ejection rollers 150 and 170.

Further, since the stoppers 320 have the rotation preventing portions 303, the rotation of the stoppers 320 is limited to always keep the stoppers 320 in the position shown in FIG. 9.

According to the present invention, the rollers 150 and 160 form a paper reversible mechanism, while the rollers 150 and 170 form a paper ejection mechanism. The paper ejection roller 150 is commonly used. Alternatively, two pairs of the paper ejection rollers may be used separately as a paper reversible mechanism and a paper ejection mechanism.

What is claimed is:

1. An image forming apparatus comprising:

a first paper ejection roller which is provided at a terminal end section of a recording media transport path and which is rotatable in forward and reverse directions;

a second paper ejection roller which is provided such that it is urged into contact with the first paper ejection roller and which rotates in the forward direction relative to the first paper ejection roller to switch back a recording medium which has been printed on one side thereof in a double side printing mode in cooperation with the first paper ejection roller;

a third paper ejection roller which is provided in a position opposite to the second paper ejection roller, with the first paper ejection roller interposed between them, such that it is urged into contact with the first paper ejection roller and which rotates in the forward direction relative to the first paper ejection roller to eject a recording medium on which printing has been completed in the double side printing mode onto an ejected paper tray in cooperation with the first paper ejection roller; and a stopper for preventing a recording medium which has been ejected onto the ejected paper tray from being caught between the first paper ejection roller and the second paper ejection roller and between the first paper ejection roller and the third paper ejection roller.

2. An image forming apparatus according to claim 1, wherein the stopper is mounted on a shaft of the first paper ejection roller, and a section of the stopper in a direction orthogonal to the axial direction of the shaft has a shape that diverges in the direction in which the recording medium is ejected.

3. An image forming apparatus comprising:

an ejected paper section to which recording paper on which printing has been completed is ejected;

a pair of paper ejection rollers, rotatable in forward and reverse directions, for transporting the recording paper in an ejecting direction by rotating in the forward direction and transporting the recording paper in a direction opposite to the ejecting direction by rotating in the reverse direction; and a stopper for preventing the recording paper ejected to the ejected paper section from contacting the pair of paper ejection rollers;

wherein the stopper is provided on at least part of the pair of paper ejection rollers so as to be rotatable relative to the paper ejection rollers.

4. An image forming apparatus according to claim 3, wherein the recording paper is allowed to be ejected to the ejected paper section by the rotation of the stopper relative to the paper ejection rollers.

5. An image forming apparatus according to claim 4, wherein a plurality of the stoppers are provided coaxially with the paper ejection rollers.

6. An image forming apparatus according to claim 3, wherein a plurality of the stoppers are provided coaxially with the paper ejection rollers.

7. An image forming apparatus comprising:

an ejected paper section to which recording paper on which printing has been completed is ejected;

a pair of paper ejection rollers, rotatable in forward and reverse directions, for transporting the recording paper in an ejecting direction by rotating in the forward direction and transporting the recording paper in a direction opposite to the ejecting direction by rotating in the reverse direction; and a stopper for preventing the recording paper ejected to the ejected paper section from contacting the pair of paper ejection rollers;

wherein the stopper has a rotation restraining portion for restraining the stopper from rotating at a predetermined angle or more relative to the paper ejection rollers.

8. An image forming apparatus according to claim 7, wherein the stopper is provided on at least part of the pair of paper ejection rollers such that it can be rotated relative to the paper ejection rollers.

9. An image forming apparatus according to claim 8, wherein a plurality of the stoppers are provided coaxially with the paper ejection rollers.

10. An image forming apparatus according to claim 7, wherein a plurality of the stoppers are provided coaxially with the paper ejection rollers.

11. An image forming apparatus comprising:

an ejected paper section to which recording paper on which printing has been completed is ejected;

a pair of paper ejection rollers, rotatable in forward and reverse directions, for transporting the recording paper in an ejecting direction by rotating in the forward direction and transporting the recording paper in a direction opposite to the ejecting direction by rotating in the reverse direction; and a stopper for preventing the recording paper ejected to the ejected paper section from contacting the pair of paper ejection rollers;

wherein a plurality of the stoppers are provided coaxially with the paper ejection rollers.

12. An image forming apparatus comprising:

an ejected paper section to which recording paper on which printing has been completed is ejected;

a first pair of transport rollers, rotatable in forward and reverse rotations, for transporting the recording paper after printing on a top side thereof in the ejecting direction of the recording paper by rotating in the forward direction, and transporting the recording paper after printing on the top side thereof in the direction opposite to the ejecting direction by rotating in the reverse direction;

a second pair of transport rollers, provided in the vicinity of the ejected paper section, for ejecting the recording paper after printing on both sides thereof to the ejected paper section by the forward rotation;

a guide member for switching transportation of the recording paper to the first pair of transport rollers and transportation of the same to the second pair of transport rollers; and a stopper for preventing the recording paper ejected to the ejected paper section from contacting at least either of the first pair of transport rollers and the second pair of transport rollers.

13. An image forming apparatus according to claim 12, wherein the stopper is provided on at least part of the first and second pairs of transport rollers so as to be rotatable relative to the transport rollers.

14. An image forming apparatus according to claim 13, wherein the stopper has a rotation restraining portion for restraining the stopper from rotating at a predetermined angle or more relative to the transport roller on which the stopper is provided.

15. An image forming apparatus according to claim 14, wherein the recording paper is allowed to be ejected to the ejected paper section by the rotation of the stopper relative to the transport roller on which the stopper is provided.

16. An image forming apparatus according to claim 14, wherein a plurality of the stoppers are provided coaxially with the transport rollers.

17. An image forming apparatus according to claim 13, wherein the recording paper is allowed to be ejected to the ejected paper section by the rotation of the stopper relative to the transport roller on which the stopper is provided.

18. An image forming apparatus according to claim 17, wherein a plurality of the stoppers are provided coaxially with the transport rollers.

19. An image forming apparatus according to claim 13, wherein a plurality of the stoppers are provided coaxially with the transport rollers.

* * * * *